US005537814A

United States Patent [19]

Nastuk et al.

[11] Patent Number: 5,537,814

[45] Date of Patent: Jul. 23, 1996

[54] HIGH PRESSURE GAS GENERATOR ROTOR TIE ROD SYSTEM FOR GAS TURBINE ENGINE

[75] Inventors: John A. Nastuk, Danvers, Mass.; Charles L. Williams, Albuquerque, N.M.

[73] Assignee: General Electric Company, Cincinnati, Ohio

[21] Appl. No.: 313,935

[22] Filed: Sep. 28, 1994

[51] Int. Cl.[6] ..... F02C 7/00

[52] U.S. Cl. ..... 60/39.31; 60/39.75

[58] Field of Search ..... 60/39.31, 39.75, 60/39.33, 39.161; 416/198 A, 244 A

[56] References Cited

U.S. PATENT DOCUMENTS

| | | | |
|---|---|---|---|
| 3,528,241 | 9/1970 | Venable et al. | 60/39.161 |
| 3,823,553 | 7/1974 | Smith | 60/39.31 |
| 3,976,399 | 8/1976 | Schmoch | 416/198 A |
| 4,057,371 | 11/1977 | Pilarczyk | 60/39.161 |
| 4,123,199 | 10/1978 | Shimizu et al. | 416/244 A |
| 4,247,256 | 1/1981 | Maghon | 416/198 A |
| 4,611,464 | 9/1986 | Hetzer et al. | 60/39.161 |
| 4,915,589 | 4/1990 | Gessler et al. | 416/244 A |
| 4,934,140 | 6/1990 | Dennison et al. | 60/39.31 |
| 4,944,660 | 7/1990 | Joco | 416/244 A |
| 5,220,784 | 6/1993 | Wilcox | 60/39.31 |

OTHER PUBLICATIONS

"Combined Power," *Flight International* 9–15 Jun. 1993, pp. 64 and 67–70.

*Primary Examiner*—Timothy S. Thorpe
*Attorney, Agent, or Firm*—Andrew C. Hess; Wayne O. Traynham

[57] ABSTRACT

An improved high pressure gas generator rotor for a gas turbine engine is disclosed in which a tie rod of unitary construction provides an axial compressive load across a plurality of non-bolted compressor and turbine components arranged in rotational driving arrangement, for example, by face splines and rabbets. An interim compressive load path solely through the compressor rotor portion is automatically provided upon relaxation of the operational compressive load in the rotor to maintain mechanical integrity of the compressor and facilitate assembly and maintenance activity. An anti-rotated midspan locknut on the tie rod obviates the need for additional, special tooling configured to clamp the compressor components during disassembly of the turbine.

20 Claims, 5 Drawing Sheets

HIGH PRESSURE GAS GENERATOR ROTOR TIE ROD SYSTEM FOR GAS TURBINE ENGINE

TECHNICAL FIELD

The present invention relates generally to a high pressure gas generator rotor configuration for a gas turbine engine and more specifically to an improved configuration tie rod system which provides interim compressive loading of selected rotor components to facilitate assembly and maintenance activities and final compressive loading of the entire rotor assembly for operational use.

BACKGROUND INFORMATION

Conventional gas turbine engine high pressure rotor designs routinely incorporate bolted flanges within and between compressor and turbine rotors to facilitate assembly and maintenance activities performed on the engine. Such connections provide varying degrees of engine modularity, whereby entire modules of an engine may be removed and replaced readily without extensive teardown of associated components. Such modularity supports rapid replacement of modules containing damaged or life limited hardware and is a highly desirable feature from a maintainability perspective. A significant limitation imposed by such designs, however, is the added weight, cost and complexity of such connections, especially in rotating components which operate at high rotational speeds in elevated temperature environments. For example, bolt holes form stress concentration zones which oftentimes are a life limiting feature of a costly compressor spool or turbine disk. Further, the added weight of bolted flange assemblies slows the thermal and inertial response of the rotor as well as increases bearing loads requiring highly complex, damped bearing systems to provide acceptable operational dynamics, especially during periods of severe imbalance such as occurs after loss of a compressor or turbine blade.

An alternative, lighter rotor design incorporates a plurality of compressor and turbine components, for example, integrally bladed disks commonly referred to as blisks, spools and disks with removeable blading, and spacer shafts, connected in rotational driving engagement by radial face splines, typically referred to as Curvic couplings, or other non-bolted connections such as rabbets. A single shaft may span solely a compressor or turbine rotor or alternatively an entire gas generator rotor assembly, applying a compressive load therethrough to prevent separation of the compressor and turbine components and related hardware. Due to the nature of a single shaft rotor system, the assembled integrity of which is maintained solely by compressive loading applied by the rotor shaft, maintenance activity performed on the rotor or modules through which the rotor passes is typically more complex than in engines having bolted flanged rotors. Extensive disassembly of unrelated hardware may be required before a target component, such as an annular combustor liner, can be accessed and replaced. In an effort to reduce such effort, special tooling can be designed and attachment features provided on the rotor and stationary frame structure of the engine to mechanically support a portion of the rotor, permitting partial disassembly thereof. In this manner, for example, the mechanical integrity of the compressor rotor can be maintained while the turbine is disassembled. Such tooling systems add cost and complexity to the user support requirements of the engine. In addition to requiring attachment features in the engine, often in high value rotor components, design constraints are imposed since unrestricted clearance and access volumes must be maintained through which such tooling passes. Further, the opportunity exists for damage to costly rotor components and proximate hardware whenever such tooling is utilized either through improper use or inadvertent contact resulting in component surface distress.

Summary of the Invention

A high pressure gas generator rotor of a gas turbine engine is comprised of at least two separable compressor stages and a turbine stage arranged in rotational driving engagement by non-bolted joints. Axial retention of the separable rotor components is afforded by application of a compressive load therethrough by a unitary tie rod system in tension, disposed in a bore portion of the rotor. Assembly and maintenance activities performed on the engine are facilitated by an anti-rotated locknut assembly mounted on a midspan portion of the tie rod which provides interim compressive loading through the compressor stages only, obviating the need for special tooling to maintain compressor integrity. Application of a final, operational compressive load through both the turbine and compressor using an endspan locknut releases the interim compressive load through the midspan locknut. Anti-rotation of the midspan locknut is afforded by internal radial tabs of an air tube which circumscribes the midspan section of the tie rod and ducts compressor bleed air to cool and/or pressurize downstream components.

BRIEF DESCRIPTION OF DRAWINGS

The novel features believed characteristic of the invention are set forth and differentiated in the appended claims. The invention, in accordance with preferred and exemplary embodiments, together with further advantages thereof, is more particularly described in the following detailed description taken in conjunction with the accompanying drawings in which:

MODE(S) FOR CARRYING OUT THE INVENTION

Figure 1:
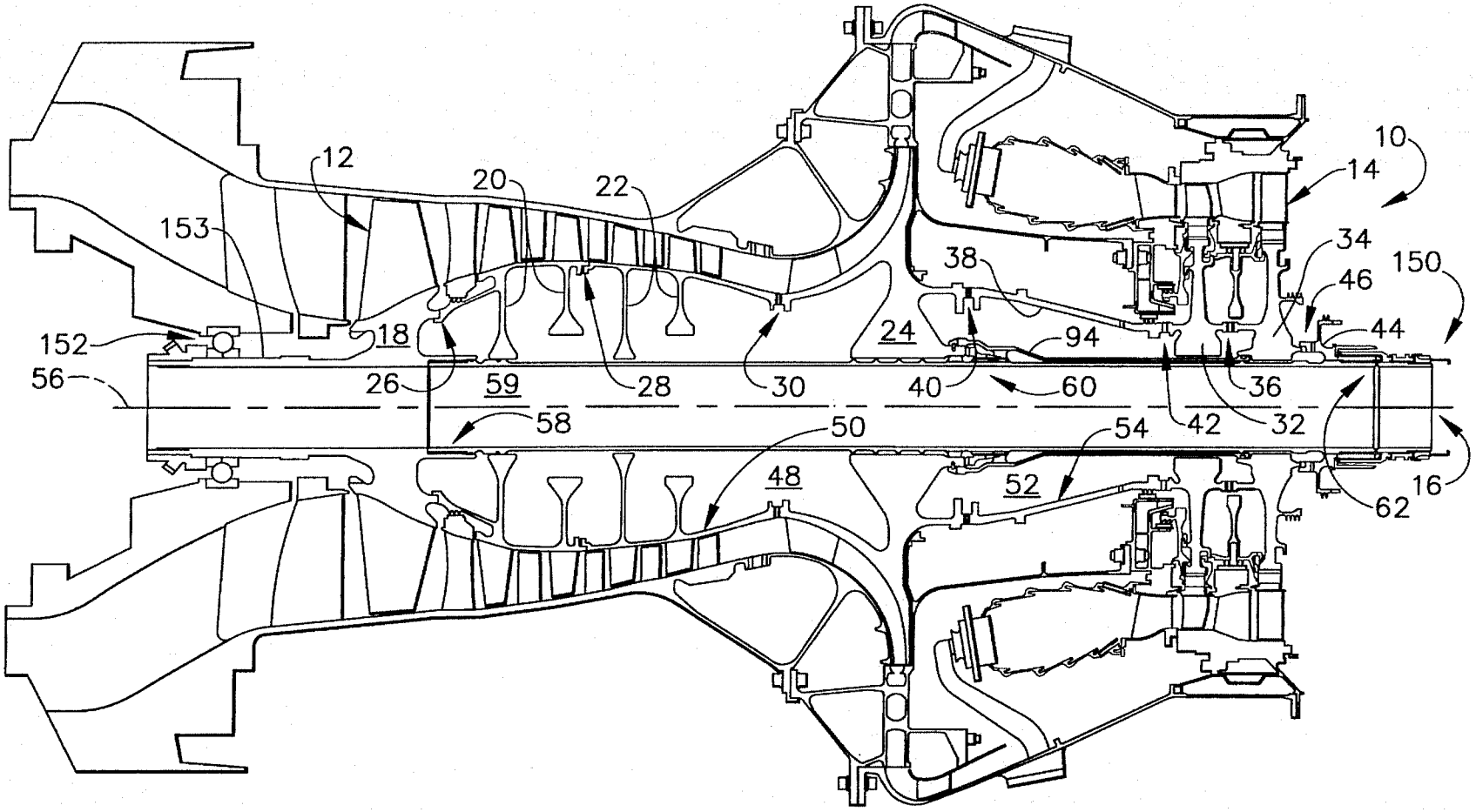
FIG. 1 is a schematic, sectional view of a high pressure gas generator rotor apparatus in accordance with a preferred embodiment of the present invention.

Shown in FIG. 1 is a schematic, sectional view of a high pressure gas generator rotor apparatus 10 in accordance with a preferred embodiment of the present invention. The rotor 10 is comprised of a compressor rotor 12, a turbine rotor 14 arranged in rotational driving engagement with compressor rotor 12, and a tie rod 16. In this depiction, the compressor rotor 12 is a five stage axial, single stage centrifugal flow design comprised of stage one blisk 18, stage two/three spool 20, stage four/five spool 22, and impeller 24. The individual components of the compressor rotor 12 are connected in rotational driving engagement by rabbet joint 26 between blisk 18 and spool 20; rabbet joint 28 between spool 20 and spool 22; and Curvic coupling 30 between spool 22 and impeller 24. In order to maintain axial engagement of the components of the compressor rotor 12, a compressive load provided by tie rod 16 traverses the rabbet joints 26, 28 and Curvic coupling 30 as will be discussed in greater detail below.

The turbine rotor 14 is comprised of stage one disk 32 connected in rotational driving engagement by Curvic coupling 36 to stage two disk 34 which in turn mates with turbine rear shaft 44 through rabbet joint 46. Impeller aft shaft 38 is disposed between compressor rotor 12 and stage one disk 32, connected respectively thereto through curvic couplings 40, 42. In order to maintain axial engagement of the components of the turbine rotor 14, a compressive load provided by tie rod 16 traverses joint 46 and couplings 36, 42. To maintain axial engagement of the components of the entire high pressure rotor 10, a compressive load path provided by tie rod 16 traverses all connections between rabbet joint 26 in the compressor rotor 12 and rabbet joint 46 in the turbine rotor 14.

A compressor rotor bore portion 48 extends radially inwardly from a load path wall 50 of the compressor rotor 12 coincident with joints 26, 28 and couplings 30, 40 and axially from blisk 18 through impeller 24. Similarly, a turbine rotor bore portion 52 extends radially inwardly from load path wall 54 of the turbine rotor 14 coincident with joint 46 and couplings 36, 42 and axially from rear shaft 44 through forward shaft 38 up to coupling 40.

Tie rod 16, a hollow, substantially cylindrical member of unitary construction, is disposed through the compressor and turbine rotor bore portions 48, 52 in a symmetrical manner about an axis of rotation 56 of high pressure rotor 10, axis 56 being substantially coincident with respective axes of rotation of the compressor and turbine rotors 12, 14. Releasable attachment means, shown generally at 58, are provided to secure the tie rod 16 to the compressor rotor 12 beyond the first rabbet joint 26. Final compressive load means, shown generally at 62, are provided to secure the tie rod 16 to the turbine rotor 14 beyond the last joint 46, thereby creating a load path through all components, joints and couplings in the high pressure rotor 10.

In order to prevent axial disengagement of the components of the compressor rotor 12 either when the final compressive load means 62 is released or before it is installed, for example during initial assembly of rotor 10, interim compressive load means, shown generally at 60, are provided. The interim means 60 sustain a low level compressive load path solely through the compressor rotor 12 to permit disassembly of components of the turbine rotor 14 without disturbing the mechanical integrity of the compressor rotor 12. Upon application of load through the final compressive load means 62, the loading of the compressor rotor 12 through the interim load means 60 is released as will be discussed in greater detail below.

It should be noted that the exemplary embodiment depicted in FIG. 1 is representative only and that the invention is applicable to a wide variety of rotor configurations, not being limited to multi-stage axicentrifugal compressor rotors driven by two stage turbine rotors. The teachings of the instant invention apply to any compressor rotor comprising at least two separable components driven by at least a single stage turbine rotor. Nor must the compressor include a centrifugal impeller, the teachings of the invention being applicable to compressors comprising two or more separable axial stages.

Figure 2:
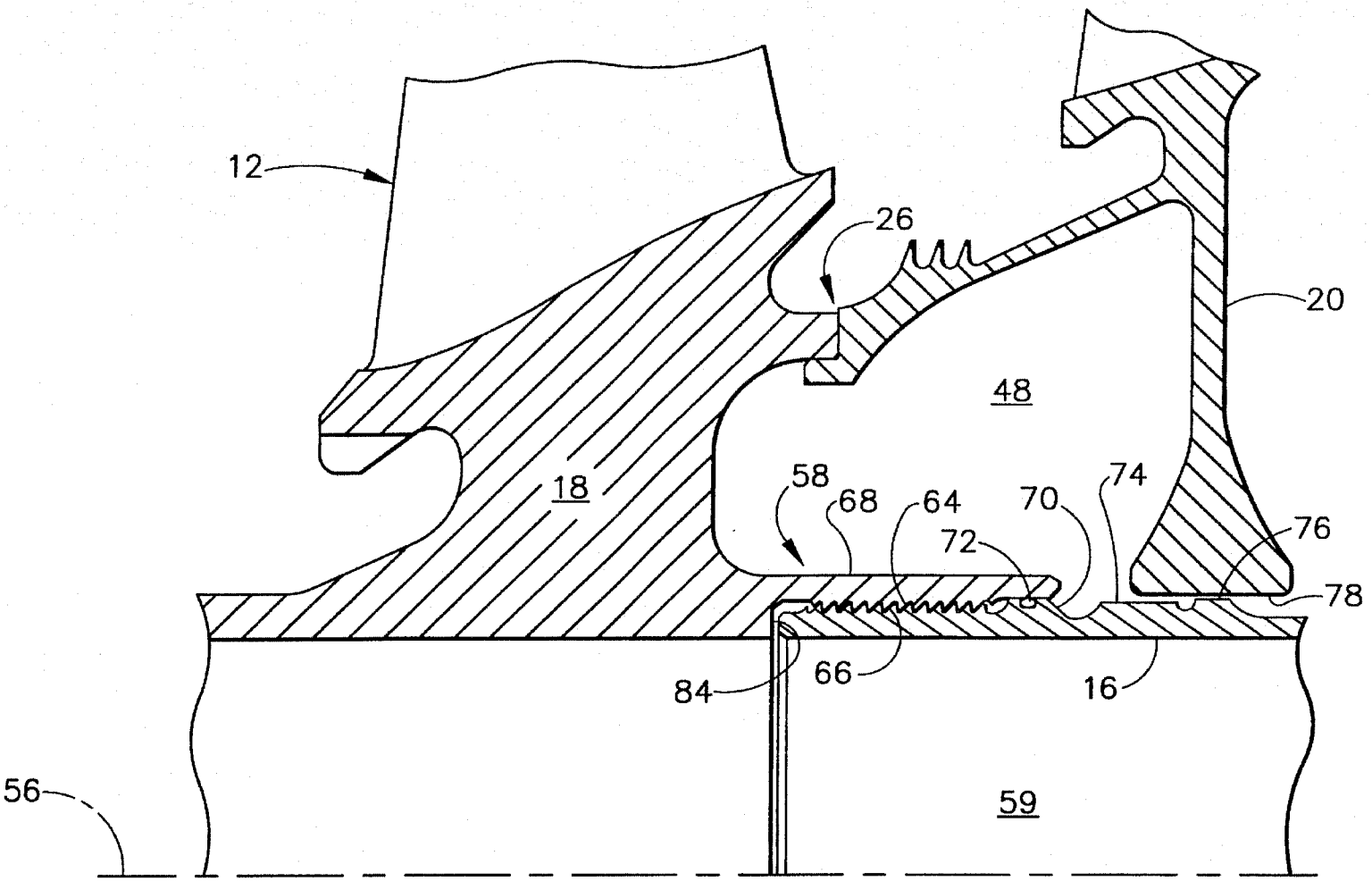
FIG. 2 is an enlarged, schematic, partial sectional view of the attachment between the tie rod and compressor rotor depicted in FIG. 1.

Looking now to each area of the tie rod 16 in greater detail, FIG. 2 is an enlarged, schematic, partial sectional view of the releasable attachment means 58 forming a connection between the tie rod 16 and compressor rotor 12 in a forward portion 59 of the tie rod 16. Attachment means 58 is comprised of an externally threaded portion 64 of tie rod 16 and a mating internally threaded portion 66 of a cylindrical socket 68 of compressor blisk 18. Due to the high compressive load required to ensure mechanical integrity of the rotor 10 during all steady state and transient operating conditions, including high speed bladeout and other events which superimpose a varying load on the baseline steady state load, in a preferred embodiment, threaded portions 64, 66 comprise British Standard buttress thread forms, substantially in accordance with American National Standards Institute (ANSI) Standard B1.9-1973, which is herein incorporated by reference.

In an exemplary embodiment, tie rod 16 is comprised of a semi-austenitic, precipitation hardenable stainless steel suitable for use in a gas turbine engine environment, having a nominal internal diameter of approximately 2.5 inches, nominal wall thickness in forward portion 59 of approximately 0.100 inches and a nominal installed axial load in excess of 70,000 pounds. Under these nominal constraints, conventional screw thread profiles which comprise symmetric thread shapes having a 60° included thread angle have been shown analytically to provide insufficient axial retention due to the tendency of the threads to part radially, slipping along 30° inclined load faces under heavy loads. The asymmetrical buttress thread form, which incorporates a near radial, 7° load face, is much better suited for the high, single direction load encountered in the instant application. In a preferred embodiment, the tie rod thread form 2,875–12 B.S. BUTT-3A and the blisk socket thread form 66 is 2.875–12 B.S. BUTT-3B. Eleven threads 64, 66 are engaged to achieve desirable load distribution and peak stress location in the tie rod 16 and blisk 18. The form and engagement of these threads (64, 66 have been shown to perform well in axial loading in excess of 90,000 pounds which corresponds to peak adverse transient operating load conditions of the rotor 10 occurring when compressor and turbine rotors 12, 14 are relatively hot and tie rod 16 is relatively cool. Major, minor and pitch diameters as well as the root radius of the thread portions (64, 66 are controlled to substantially meet the aforementioned ANSI specification; however, minor changes to the thread form nominal values or tolerance bands may be designated as a result of tailoring to a specific application based on stress analysis as conventionally applied by those skilled in the art of technical design. For example, tie rod life has been shown to be sensitive to the root radius of the thread form, specified in the standard as having a value of 0.010 inches. No dimensional tolerance is provided. In a preferred embodiment, thread portions 64, 66 are controlled with a root radius value between about 0.009 inches and 0.012 inches. Such control is desirable as worst stack tolerance of major, minor and pitch diameters permitted by the standard could result in a root radius value substantially smaller than 0.010 inches. Such sharp contours may give rise to unacceptably high local stresses and steep stress gradients in the threads 64, 66 which would limit the useful life of the tie rod 16 or cause premature failure of the threads 64, 66 under high loads.

Proximate threads 64 on the tie rod 16 is a centralization rib 70 which further includes provision for a preformed packing such as O-ring 72. Rib 70 functions to centralize the tie rod 16 in the socket 68 to prevent radial shifting of the threads 64, 66 during operation with a concomitant adverse impact on dynamic balance of the rotor 10. A small machined diametral clearance between the rib 70 and socket 68 is compensated for by a graphite based, dry film lubricant which coats the rib 70 prior to assembly. When the tie rod 16 is threaded into the socket 68, excess lubricant is scraped from the rib 70, leaving a line on line fit. O-ring 72 is employed as an air seal to prevent leakage of stage five compressor bleed air, which enters the compressor bore 48 through Curvic 30, into lower pressure buffer air disposed between the tie rod 16 and a fan drive shaft (not shown) disposed therethrough.

Tie rod 16 further comprises a sacrificial balance land 74 in the forward portion 59 and a similar feature in aft portion 63 from which material may be removed, for example by grinding, to permit two plane dynamic balancing of the tie rod 16, as is conventionally known. Lastly, the forward portion 59 of the tie rod 16 comprises a bend limiting rib 76 which is disposed, in this embodiment, proximate a bore portion 78 of the stage two/three spool 20. The rib 76 contacts bore 78 during periods of high rotational imbalance occurring, for example, during a bladeout event, thereby preventing excessive rotor deflection which could cause separation of rabbet joint 26 resulting in further damage to the rotor 10 and engine. Once contact occurs between rib 76 and bore 78, further radial deflection of the compressor rotor 12 is limited by the stiffness of the tie rod 16. A conventional rotordynamic analysis, governed by the ratio PR/M, is applied to ascertain whether tie rod axial load P is sufficient, given the radial distance R of a joint or coupling of interest from the axis of rotation 56 and the induced moment M at this joint or coupling caused by the unbalance condition. A ratio value greater than about two indicates separation of the rabbet joint of interest will not occur. Radial clearance between rib 76 and bore 78 in the instant application is nominally set at 0.010 inches to prevent contact during normal operation while providing positive contact at a predetermined threshold rotor imbalance level to prevent separation of rabbet joint 26, the depiction of clearance in FIG. 2 being exaggerated for clarity. In addition to preventing rotor separation during extreme operating events, addition of rib 76 precludes the need for even higher tie rod loads to preserve mechanical integrity of rotor 10, thereby enhancing low cycle fatigue and creep life of tie rod 16.

Figure 3:
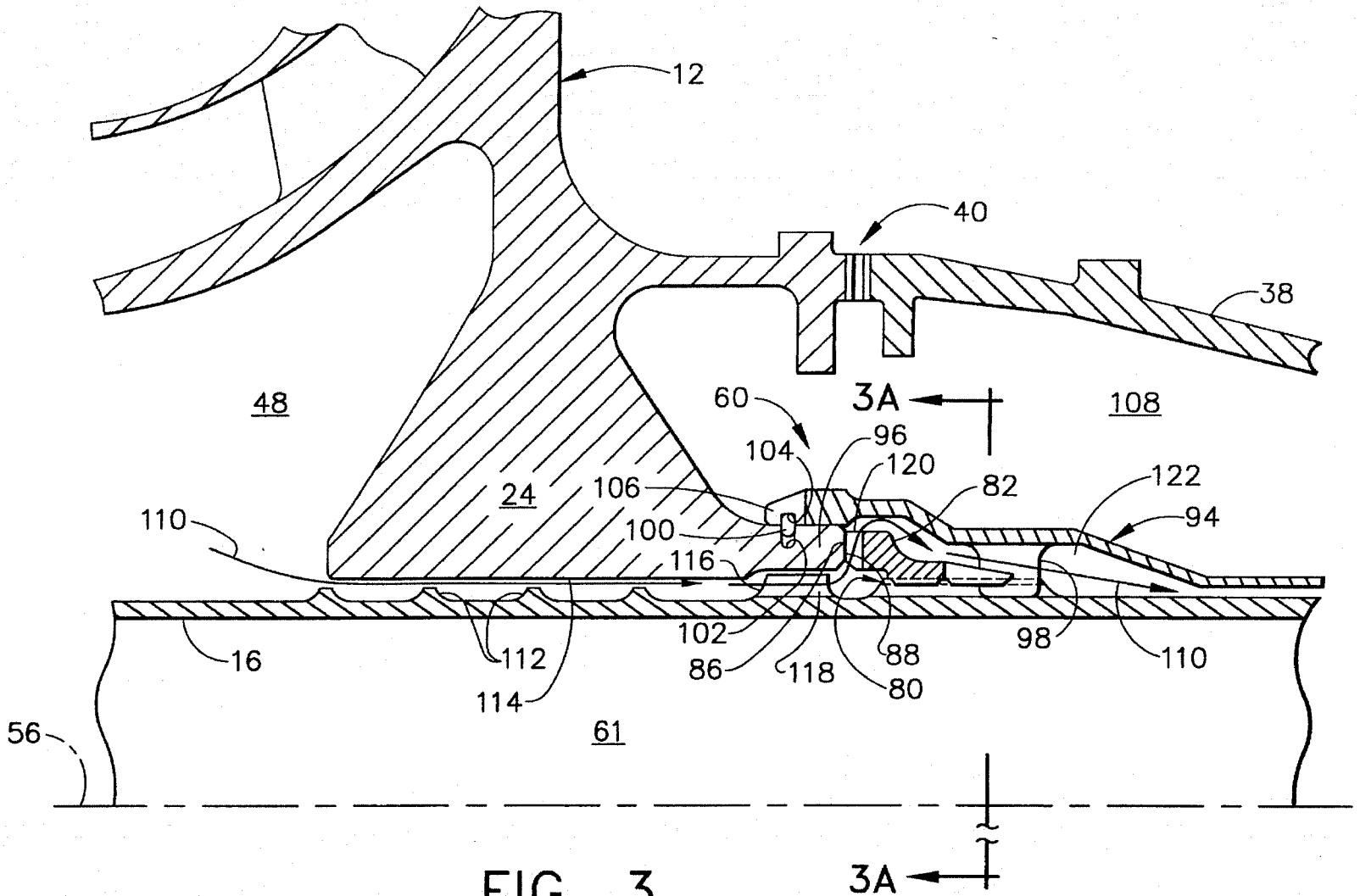
FIG. 3 is an enlarged, schematic, partial sectional view of the midspan locknut assembly depicted in FIG. 1.

Interim compressive loading solely through the compressor rotor 12 is provided by the tie rod attachment means 58 in cooperation with interim load means 60 shown in detail in FIG. 3 which depicts a midspan portion 61 of the tie rod 16. A midspan locknut 82 of a conventional self-locking type is threadedly engaged with a second externally threaded portion 80 of tie rod 16, the mating threads comprising standard 60° thread forms, for example 3.000–16 UNJ-3A. Buttress or other thread forms could be utilized; however, the loads transmitted therethrough are relatively small, for example between about 88,000 pounds and 15,000 pounds, well within the load capability of standard thread forms of this size.

Figure 3A:
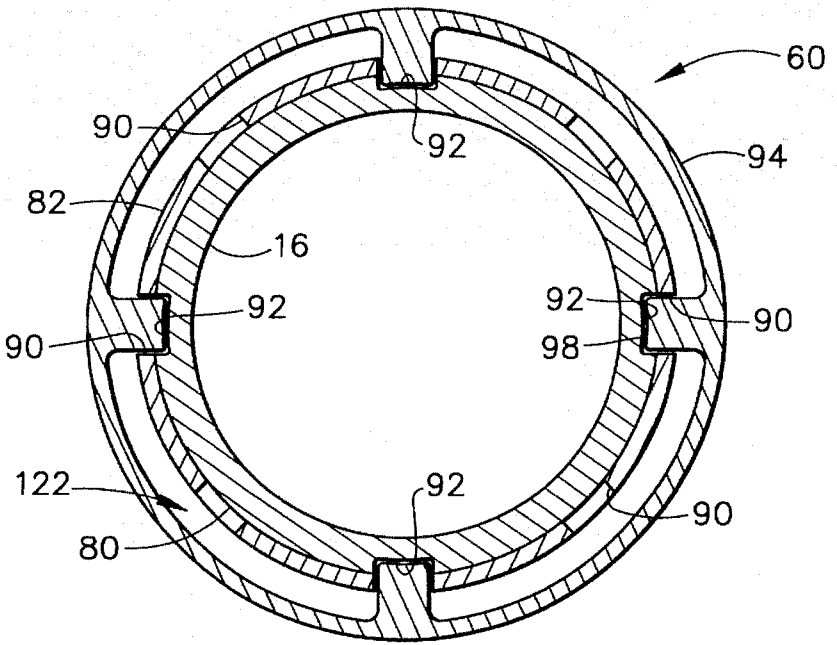
FIG. 3A is a schematic sectional view of the midspan locknut assembly shown in FIG. 3 taken along line 3A—3A.

During initial vertical assembly of the rotor 10, spools 20, 22 and impeller 24 are serially installed on blisk 18, ensuring proper registration of rabbets 26, 28 and Curvic 30. The tie rod 16 is then passed through the bore 48 and threaded into the socket 68 in the blisk 18 until it bottoms on radial face 84 depicted in FIG. 2. The locknut 82 is installed on tie rod 16 and advanced until a locknut forward face 86 contacts a radial stub face 88 of the impeller 24. The tie rod 16 is then unscrewed from the blisk 18 approximately 30° in order to prevent preloading of threads 64, 66. Being of the self-locking type, the locknut 82 travels with the tie rod 16 as the tie rod 16 is unscrewed. A minimum 10,000 pound load is subsequently applied to the assembly by pulling on the tie rod 16 while restraining the impeller 24 utilizing conventional hydraulic tooling. The locknut 82 is then advanced an additional 60° to 105° until a castellation slot 90 in the locknut 82 aligns with an axial slot 92 in the tie rod threads 80 as best seen in FIG. 3A. Slot 92 extends radially through the threads 80 only and not through tie rod 16. Depending on cumulative tolerances of the components being assembled, the assembly load may need to be somewhat greater than 10,000 pounds to permit advancement of the locknut 82 within the predetermined angular range. After the locknut 82 is advanced the requisite amount, the hydraulic load is relaxed, leaving a residual load path solely through the compressor rotor 12 and tie rod 16 between the attachment means 58 and interim load means 60. In the exemplary embodiment depicted, four equiangularly spaced slots 92 are configured in the tie rod threads 80 and eight equiangularly spaced castellation slots 90 are disposed through the locknut 82 such that the resultant axial load is never greater than about 15,000 pounds for this particular configuration. Interim loading through the compressor rotor 12 may be modified as desired by controlling hydraulic preloading of the assembly and angular advancement of locknut 82.

Referring again to FIG. 3, in order to anti-rotate the locknut 82 and tie rod 16 relative to the impeller 24, air tube 94 is installed which circumscribes an aft stub 96 of impeller 24 in interference fitting relation. The air tube 94 is heated prior to installation to facilitate assembly, the interference fit ensuring centralization of the air tube 94 on the rotor 10. Radially inwardly extending tabs 98 of air tube 94 are disposed through the aligned locknut castellation slots 90 and tie rod thread slots 92. Snap ring 100, disposed in a suitably dimensioned groove 102 in stub 96 and groove 104 in air tube 94 provides a redundant means for preventing axial migration of the air tube 94 during engine operation. A plurality of radial slots 106 are provided in the air tube 94 proximate snap ring 100 to permit access by tooling employed to compress the snap ring 100 allowing the air tube 94 to be removed from the stub 96 at disassembly by appropriate means, for example with an hydraulically actuated puller.

In addition to anti-rotating the locknut 82 and tie rod 16, air tube 94 isolates stage five compressor bleed air in compressor bore 48 from higher temperature impeller tip aft bleed air in cavity 108 as the stage five bleed air travels aft along arrow 110 through annular flow channel 122 to pressurize and/or cool downstream components. The interference fit between the air tube 94 and impeller stub 96 provides a sufficient air seal, although additional seal means could be provided if warranted.

Raised rib turbulators 112 provided on the tie rod 16 proximate the impeller bore 114 create turbulence in the bleed flow 110 as it passes thereby enhancing the thermal response and life of the impeller 24 and cooling the tie rod 16. Turbulators 112 add little weight to the tie rod 16 and maintain greater flexibility than the addition of an axially extended raised land to accelerate flow 110 thereby. Wall thickness of the tie rod 16 in the midspan portion 61 is increased 0.005 inches to a nominal value of 0.105 inches due to an increase in the operating temperature environment experienced by the midspan portion 61 as well as to accommodate stress concentration associated with turbulators 112.

A snubber land 116 is also disposed on the tie rod 16, extending radially outwardly proximate stub 96, leaving a nominal radial gap therebetween of about 0.005 inches, the magnitude of which has been exaggerated in the depiction in FIG. 3. Land 116 limits radial excursion of the tie rod 16 due, for example, to excessive engine vibration or tie rod vibration caused by transient resonance conditions. Additionally, the land 116 limits excursions in the event of intermittent contact between the tie rod 16 and orbiting shafting disposed therethrough, for example a whipping fan drive shaft (not shown) excited by fan blade damage imbalance. Land 116 is coated with a graphite based dry lubricant to prevent fretting of the stub 96 and further has a plurality of axial slots 118 disposed therethrough to provide for unrestricted passage of cooling flow 110. Similarly, the locknut forward face 86 has a plurality of radial slots 120 to provide for unrestricted passage of cooling flow 110 thereby. An exemplary embodiment comprises eight axial slots 118 and twelve radial slots 120. Wall thickness of the tie rod 16 aft of snubber land 116 is increased an additional 0.005 inches to a nominal value of 0.110 inches which remains substantially constant through the aft portion 63 of tie rod 16. Increased wall thickness in the hotter ambient environments of the midspan and aft portions 61, 63 of the tie rod 16 is desirable for maintaining adequate creep life margin. Wall thickness is controlled in accordance with conventional design practice for safety critical, high speed rotating components, in order to maintain tie rod flexibility and enhance low cycle fatigue life.

Figure 4:
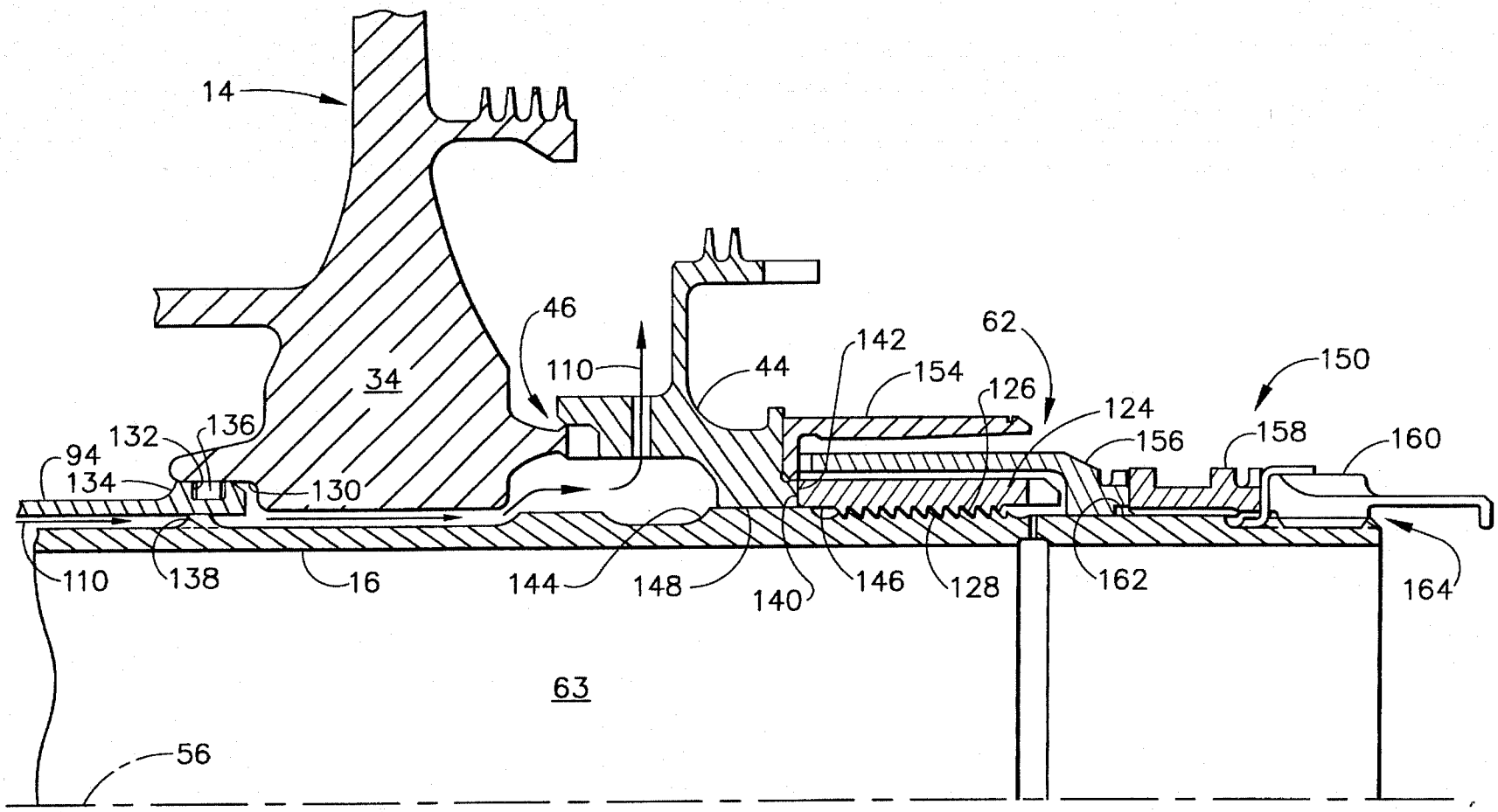
FIG. 4 is an enlarged, schematic, partial sectional view of the endspan locknut assembly depicted in FIG. 1.

Referring now to FIG. 4, air tube 94 terminates in a bore 130 of the stage two turbine disk 34. A piston ring groove 132 is disposed in a raised rib 134 of air robe 94 and an interlocking tang piston ring 136 is disposed therein, providing a sliding, high temperature air seal to accommodate assembly and thermal growth of the rotor 10. The air tube 94 is radially located in bore 130 by a raised rib 138 disposed on the tie rod 16 which is suitably slotted in the axial direction to permit unrestricted passage of cooling flow 110 thereby.

Once the impeller aft shaft 38, stage one disk 32, stage two disk 34 and turbine rear shaft 44 have been serially installed, ensuring proper registration of couplings 40, 42, and 36 and joint 46, operational compressive loading of the rotor 10 is afforded by final load means 62. Load means 62 is comprised of an endspan locknut 124 having internal threads 128 threadedly engaged with a third externally threaded portion 126 located on an aft portion 63 of tie rod 16. Locknut 124 is advanced until a radial load face 140 contacts aft face 142 of rear shaft 44. A 73,500 nominal operational load is axially applied using conventional hydraulic techniques to compress the compressor and turbine rotors 12, 14 while stretching the tie rod 16. The locknut 124 is advanced until faces 140, 142 once again contact and the externally applied load is released. Axial elastic deformation or stretch of the tie rod 16 over its length functions to unload the compressive load path through the compressor rotor 12 applied by the interim load means 60. Under the full operational load, an axial gap of approximately 0.050 inches or more is created between faces 86, 88 of midspan locknut 82 and impeller 24, respectively. Final compressive loading and mechanical integrity of the entire rotor 10 is thereby provided by the tie rod attachment means 58 in cooperation with final load means 62. A conventional self-locking feature of midspan locknut 82 prevents rattling of the unloaded locknut 82 during engine operation. Air tube tabs 98 prevent migration of locknut 82 on tie rod threads 80 in the event the self-locking feature becomes ineffective.

In a preferred embodiment, threads 126, 128 of final load means 62 comprise British Standard buttress thread forms, substantially in accordance with ANSI Standard B1.9-1973 as discussed hereinbefore. Here too, root radius is controlled between 0.009 inches and 0.012 inches. Additionally, unlike threads 64, 66 in releasable attachment means 58 in which all thread profiles are substantially uniformly loaded due to the axial load transmitted therethrough, threads 126, 128 transmit a reversing load profile. In a threaded joint of this type, a significant portion of the axial load is borne by a first engaged thread, as is conventionally known, with little load being carried by remaining engaged threads. In order to afford substantially uniform loading across all engaged threads to normalize stress profile and enhance thread life, a lead correction adjustment is advantageously applied. For example, in a preferred embodiment having a minimum of nine engaged threads, tie rod threads 126 comprise 2.875–12 B.S. BUTT-3A whereas locknut threads 128 comprise 2.875–11.9284 B.S. BUTT-3B. These respective thread pitch values create 0.08333 inches per thread on the tie rod 16 and 0.08383 inches per thread on the locknut 124, resulting in a nominal lead correction of 0.0005 inches per thread.

Figure 5:
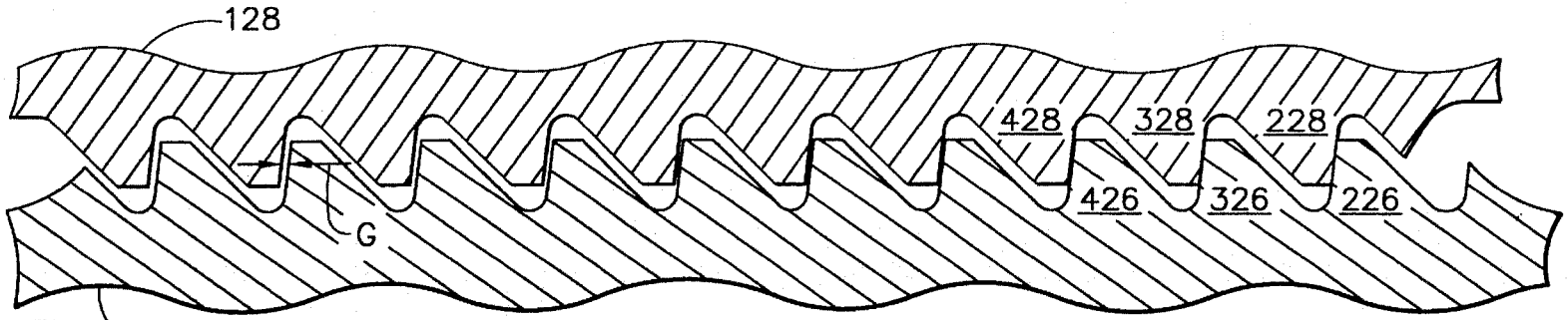
FIG. 5 is an exaggerated, schematic, enlarged sectional view of the threaded connection between the endspan locknut and tie rod depicted in FIG. 4.

As best seen in the exaggerated depiction of FIG. 5, in an unloaded condition, aftmost thread pair 226, 228 have load faces in contact. Progressing to the left as shown in this figure, respective thread pairs progressively have gaps 6 disposed between load faces of arithmetically increasing magnitude, in 0.0005 inch increments. In other words, a 0.0005 inch gap exists between thread pair 326, 328; a 0.0010 inch gap exists between thread pair 426, 428; etc. By the ninth thread pair, the gap has increased to 0.0040 inches. As loading across threads 126, 128 is increased, elastic deformation brings successive thread pairs into contact such that at a predetermined design load, all thread pairs are substantially uniformly loaded. The amount of lead correction possible is limited, inter alia, by the design form of the thread and the number of engaged thread pairs; however, sufficient correction is available within existing thread contours in an exemplary embodiment to reduce peak stress areas, thereby increasing fatigue life.

To further control loading through threads 126, 128 as well as prevent radial shifting of the threads 126, 128 during operation with a concomitant adverse impact on dynamic balance of the rotor 10, a raised radial land 144 is provided on the tie rod 16 as shown in FIG. 4. A pilot bore 146 of locknut 124 is located on land 144 at assembly under operational loading. A small diametral clearance between the bore 146 and land 144 is compensated for by a graphite based, dry film lubricant which coats the bore 146 prior to assembly. When the threads 126, 128 are engaged and the locknut advanced, excess lubricant is scraped from the bore 146, leaving a line on line fit. Perpendicularity and axial runout of faces 140, 142 are tightly controlled at manufacture to minimize non-axial loading. Yet further, a slight interference fit condition exists between land 144 and aft shaft bore 148 to prevent relative movement and maintain concentricity and rotor balance.

Tie rod aft portion 63 further comprises aft bearing means, shown generally at 150, which operates in combination with forward bearing means 152 disposed on forward shaft 153 of blisk 18, to rotationally support the rotor 10 as best shown in FIG. 1. Referring back to FIG. 4, after locknut 124 has been installed and the rotor 10 compressed to operational load, seal runner 154, bearing spacer 156, bearing inner race 158, and bearing locknut 160 are serially installed. Spacer 156 and inner race 158 are located on an accurately machined bearing journal surface 162 of tie rod 16. Cooperating threads 164 of bearing locknut 160 and tie rod 16 are conventional, with locknut 160 being tightened sufficiently to stabilize the bearing means 150. Care is taken in the manufacture of tie rod 16 and components forming rotor 10 to ensure concentricity and perpendicularity of mating components, thereby minimizing non-axial loading or bending of the components during assembly and induced operational stresses.

During disassembly of rotor 10, removal of the endspan locknut 124 relieves compressive loading of the turbine rotor 14 and tensile loading in the tie rod 16 aft of midspan locknut 82. The compressor rotor 12 remains in compression at the interim load level of between about 8,000 pounds and about 15,000 pounds until the midspan locknut 82 is removed. Interim compression of the compressor rotor 12 significantly facilitates assembly and maintenance activity on the rotor 10 and on any engine in which rotor 10 is installed. The interim load through the compressor rotor 12 prevents undue hardware shifting and resultant damage caused by loose joints and connections. Further, the interim load is automatically applied upon decrease in overall tie rod tension below a predetermined threshold value established, inter alia, by the axial location of the midspan locknut 82 on the tie rod 16, the magnitude of the interim load and the elasticity or strain characteristic of the tie rod 16. No additional tooling, specialized knowledge or access to nested rotor or engine structural zones are required.

While there have been described herein what are considered to be preferred embodiments of the present invention, other modifications of the invention will be apparent to those skilled in the art from the teaching herein. For example, tie rod 16 need not terminate in a threaded socket 68 but could be attached by other means or pass through blisk 18, being secured with a locknut, and further having provision for forward bearing journal means. The tie rod could be made of any suitable material, such as Inconel 718, titanium or managed steel, depending on the temperature and stress environment encountered. Midspan locknut 82 could be located at a different location to provide interim loading through more than solely the compressor rotor 12, or only a portion thereof. Alternatively, multiple midspan locknuts could be provided to maintain the mechanical integrity of discrete portions of rotor 10 or the interim load path directed solely through the turbine rotor 14, or only a portion thereof. Instead of the midspan locknut 82, other features could be incorporated to provide interim loading through the compressor rotor 12 or a portion of the rotor 10. For example, a bayonet style retention feature could be incorporated on an air robe or other component with tangs interlocking with similar features disposed on a compressor impeller. Also, differing means for preventing axial migration of the preferred embodiment air tube 94 other than snap ring 100 are contemplated, including a flexible retention wire insertable through a radial hole into a circumferential groove traversing the air tube/impeller joint or a raised rib disposed on a distal end of an air tube abutting a portion of a turbine rotor. Further, instead of varying the pitch of buttress threads 126, 128 to achieve uniform stress profile, other thread forms could be used and/or an endspan locknut incorporated having an external rib at a predetermined axial location, load being transmitted therethrough, instead of through load face 140, to modify the stress profile in the threads. Alternatively, instead of carrying full axial operational load through endspan locknut 124, load may be shared in a parallel load path through bearing spacer 156, race 158 and locknut 160.

It is therefore desired to be secured in the appended claims all such modifications as fall within the true spirit and scope of the invention. Accordingly, what is desired to be secured by Letters Patent of the United States is the invention as defined and differentiated in the following claims.

We claim:

1. A high pressure gas generator rotor for a gas turbine engine comprising:

a compressor rotor comprising:

at least a first compressor stage and a second compressor stage connected in rotational driving engagement thereto;

a compressor rotor bore portion; and a compressor rotor axis of rotation;

a turbine rotor comprising:

at least a last turbine stage;

a turbine rotor bore portion; and a common axis of rotation with said compressor rotor, said turbine rotor being connected in rotational driving engagement thereto; and a tie rod of unitary construction disposed through respective bore portions of said compressor and turbine rotors, aligned concentrically about said axis of rotation, said tie rod comprising:

means for releasably attaching a first end of said tie rod to said compressor rotor;

means for applying an interim compressive load through a portion of said gas generator rotor for preventing axial disengagement of said at least first and second compressor stages of said compressor rotor; and means for applying a final compressive load through both said compressor and turbine rotors whereby application of said final compressive load releases loading of said gas generator rotor portion through said interim load means.

2. The invention according to claim 1 wherein:

said interim load means comprises a midspan locknut threadedly engaged with a first threaded portion of said tie rod, a radially disposed face of said midspan locknut reacting against a radially disposed face of said compressor rotor.

3. The invention according to claim 2 wherein:

said interim load means further comprises means for anti-rotating said midspan locknut relative to said tie rod.

4. The invention according to claim 3 wherein:

said midspan locknut anti-rotation means comprises a tab of an air tube member disposed simultaneously through a radial slot in said midspan locknut and a radial slot in said first threaded portion in radially aligned registration therewith.

5. The invention according to claim 4 wherein:

said air tube further comprises retention means to prevent axial and circumferential migration of said air tube relative to said second compressor stage.

6. The invention according to claim 5 wherein:

said retention means comprises a radial interference fit.

7. The invention according to claim 6 wherein:

said retention means further comprises a snap ring disposed in radially aligned groove portions in said second compressor stage and said air tube member.

8. The invention according to claim 4 wherein:

said air tube member comprises a substantially cylindrical hollow tube disposed radially outwardly from said tie rod between said second compressor stage and said turbine rotor, forming an annular flow channel therebetween for ducting cooling air between said compressor rotor bore portion and said turbine rotor bore portion.

9. The invention according to claim 8 wherein:

said air tube member further comprises first seal means disposed proximate said second compressor stage and second seal means disposed proximate said turbine rotor.

10. The invention according to claim 9 wherein:

said first seal means comprises an interference fit and said second seal means comprises a piston ring.

11. The invention according to claim 1 wherein:

said releasable attachment means comprises a threaded proximal end portion of said tie rod threadedly engaged with a threaded socket in said first compressor stage.

12. The invention according to claim 11 wherein:

said threaded proximal end portion and said threaded socket comprise British Standard buttress thread forms.

13. The invention according to claim 11 wherein:

said tie rod further comprises seal means disposed between said tie rod and said socket to prevent leakage of air in said compressor rotor bore through said attachment means.

14. The invention according to claim 1 wherein:

said final load means comprises an endspan locknut threadedly engaged with a threaded distal end portion of said tie rod proximate said last turbine stage, a radially disposed face of said endspan locknut reacting against a radially disposed face of said turbine rotor.

15. The invention according to claim 14 wherein:

threads of said endspan locknut and threads of said tie rod distal end portion comprise British Standard buttress thread forms.

16. The invention according to claim 15 wherein:

said respective thread forms of said endspan locknut and said tie rod distal end portion comprise different pitch values.

17. The invention according to claim 1 further comprising:

means for initially balancing said tie rod; and means for limiting bending of said tie rod during periods of operational imbalance of said gas generator rotor.

18. The invention according to claim 1 wherein:

said tie rod further comprises heat transfer enhancement means to enhance heat transfer between said compressor rotor bore portion and cooling air flowing thereby.

19. The invention according to claim 1 wherein:

said tie rod further comprises means for mounting bearing means to provide rotational support of said gas generator rotor.

20. A high pressure gas generator rotor for a gas turbine engine comprising:

a compressor rotor comprising:

at least a first axial flow compressor stage and a last centrifugal flow compressor stage connected in rotational driving engagement thereto;

a compressor rotor bore portion; and a compressor rotor axis of rotation;

a turbine rotor comprising:

at least a last turbine stage;

a turbine rotor bore portion; and a common axis of rotation with said compressor rotor, said turbine rotor being connected in rotational driving engagement thereto; and a tie rod of unitary construction disposed through respective bore portions of said compressor and turbine rotors, aligned concentrically about said axis of rotation, said tie rod comprising:

means for releasably attaching a first end of said tie rod to said first axial flow compressor stage;

means for applying an interim compressive load through said last centrifugal flow compressor stage for preventing axial disengagement of said first axial flow compressor stage and said last centrifugal flow compressor stage of said compressor rotor; and means for applying a final compressive load through both said compressor and turbine rotors whereby application of said final compressive load releases loading of said compressor rotor through said interim load means.

* * * * *